United States Patent [19]

Wallis

[11] Patent Number: 4,838,065

[45] Date of Patent: Jun. 13, 1989

[54] CORRUGATED FIN FORMING APPARATUS

[76] Inventor: Bernard J. Wallis, 2215 Dacosta, Dearborn, Mich. 48128

[21] Appl. No.: 139,917

[22] Filed: Dec. 31, 1987

[51] Int. Cl.[4] ..... B21D 13/04

[52] U.S. Cl. ..... 72/185; 72/187

[58] Field of Search ..... 72/185, 187

[56] References Cited

U.S. PATENT DOCUMENTS 767,883 8/1904 Grafton ..... 72/187

2,071,584 2/1937 Shippy ..... 72/185

FOREIGN PATENT DOCUMENTS 2156108 10/1985 United Kingdom ..... 72/187

*Primary Examiner*—Lowell A. Larson

*Attorney, Agent, or Firm*—Barnes, Kisselle, Raisch, Choate, Whittemore & Hulbert

[57] ABSTRACT

A corrugating web forming apparatus for receiving selectively a plurality of webs of flat material and slitting each of said webs to form two strips which are thereafter shaped to form corrugations and severed to form shaped portions having predetermined lengths, predetermined height and predetermined spacing between the corrugations which comprises a slitting station including at least two sets of slitting rolls adapted to be used selectively for slitting a respective web, a forming station including at least two sets of forming rolls for transversely corrugating two strips severed from a web simultaneously, a plurality of longitudinally roll pack stations comprising at least two sets of forming rolls for controlling the longitudinally spacing between the corrugations on the strips, a web control station including at least two sets of rolls for engaging and intermittently interrupting the movement of the corrugated strips, and a cutting station for cutting predetermined lengths from said corrugated strips. Provision is made for adjusting the orientation of the rolls of one packing station relative to another to adjust the pitch or distance between corrugations. Provision is also made for selectively driving one set of the forming rolls for each strip without driving the other set of forming rolls.

15 Claims, 13 Drawing Sheets

FIG.3
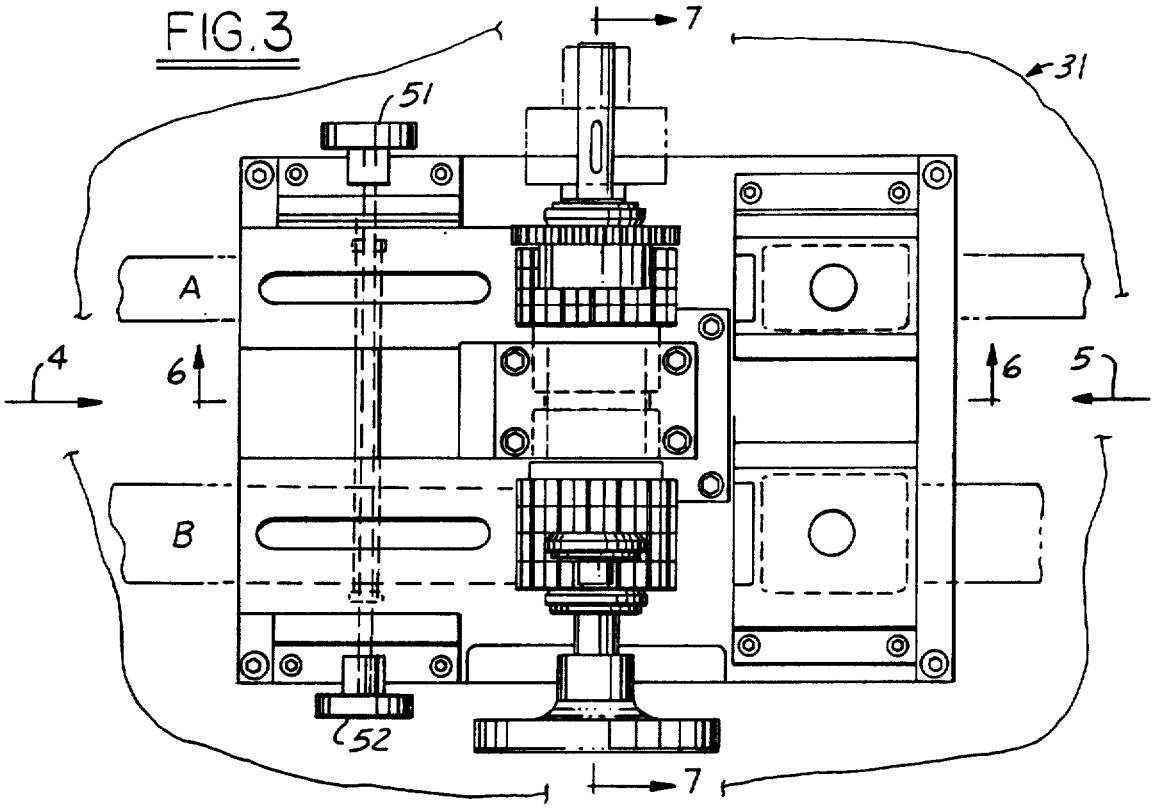
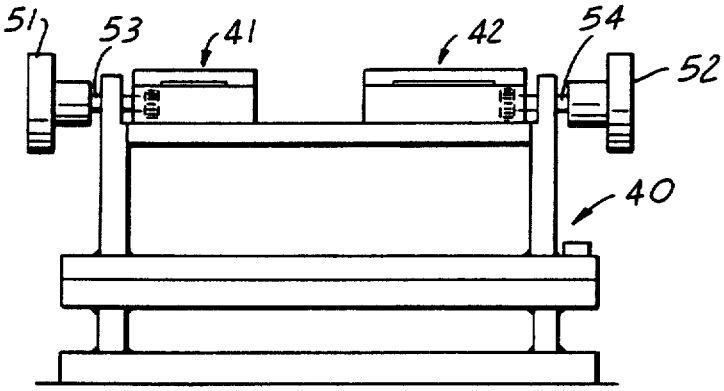
FIG.4
FIG.5
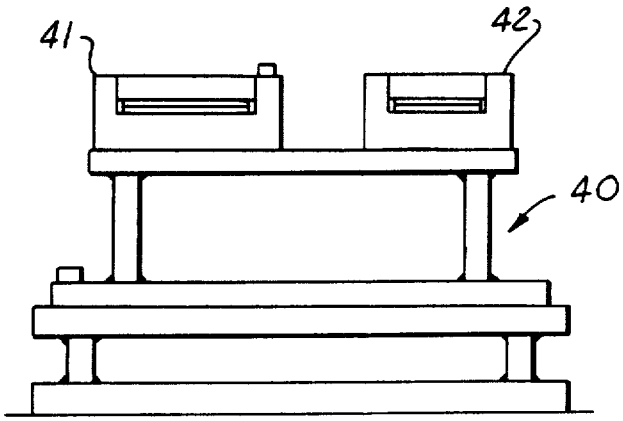

FIG.8
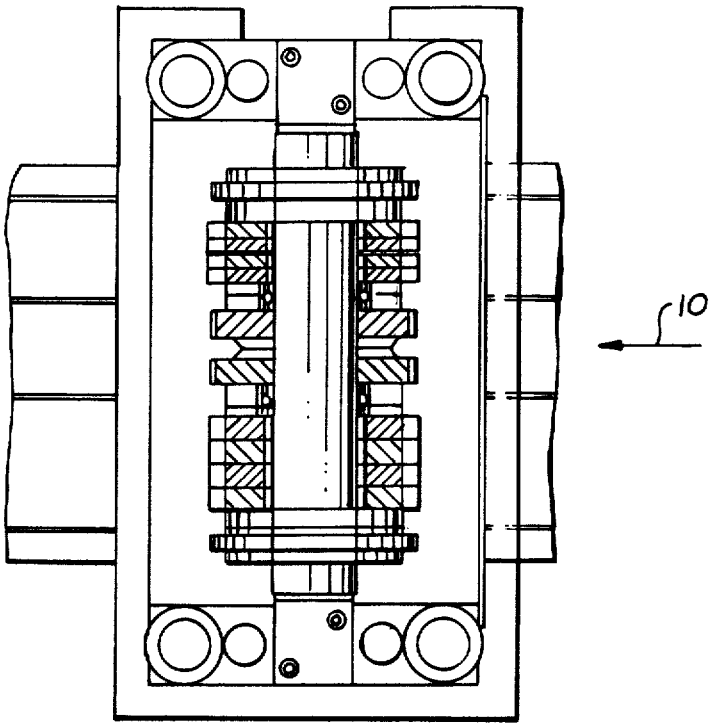
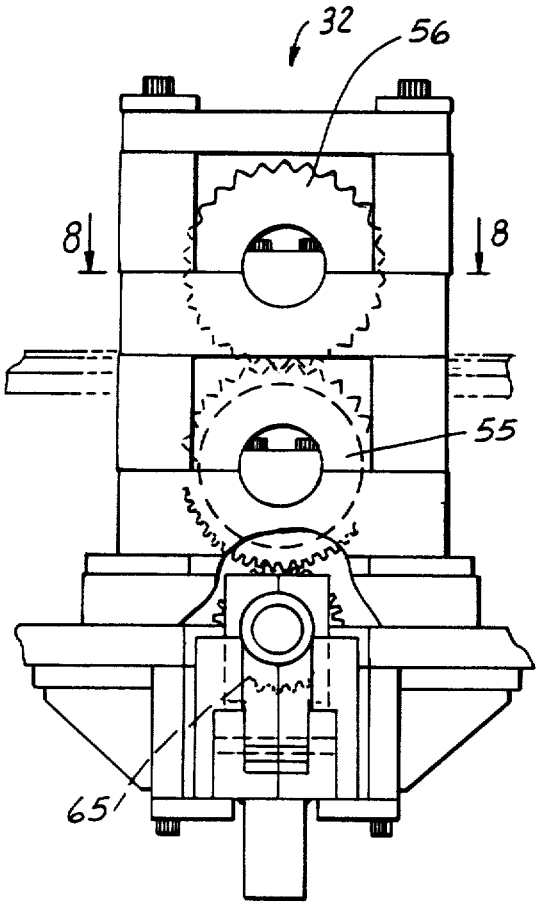
FIG.9
FIG. 12
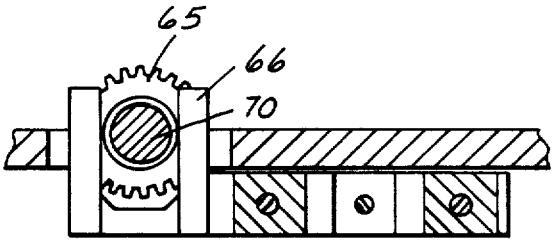

CORRUGATED FIN FORMING APPARATUS

This invention relates to corrugated fin forming apparatus utilized to manufacture heat exchanger strips, that is, a metal strip having transversely extending corrugations along the length thereof.

BACKGROUND AND SUMMARY OF THE INVENTION

In the manufacture of metal strips having transversely extending corrugations along the length thereof, it is common to feed the stock from a coil between forming rolls to form the corrugations. Typical apparatus for use in such manufacture is shown, for example, in U.S. Pat. Nos. 3,998,600, 4,067,219, 4,262,568 and 4,507,948.

Among the objectives of the present invention are to provide an apparatus which will produce metal strips having high productivity; wherein the apparatus can be quickly changed to produce multiple strips simultaneously; wherein the apparatus can be quickly changed to produce strips of different widths; which can utilize a web from a coil of greater width that is slitted to form plural strips simultaneously.

Among the further objectives of the present invention are to provide a forming or fin generating station which has greater length of service and thereby increases productivity without adversely affecting the quality of the product; which has packing roll stations, each of which is independently adjustable during operation; which has improved control of concentricity of the rolls; wherein the packing roll stations may be independently adjusted with respect to prior stations for changing the pitch or distance between corrugations during operation; wherein the rolls can be easily removed and replaced thereby minimizing downtime; and wherein a further station is intermittently driven to control the number of fin convolutions per inch; and which has a cut-off station which is movable selectively transversely of the apparatus to sever a length of fins.

In accordance with the invention, the corrugating web forming apparatus for receiving selectively a plurality of webs of flat material and slitting one of said webs to form two strips which are thereafter shaped to form corrugations and severed to form shaped portions having predetermined lengths and predetermined spacing between the corrugations comprises a slitting station including at least two sets of slitting rolls adapted to be used selectively for slitting a respective web, a forming station including at least two sets of forming rolls for transversely corrugating two strips severed from a web simultaneously, a plurality of longitudinally roll pack stations comprising at least two sets of forming rolls for controlling the longitudinal spacing between the corrugations on the strips, a web control station including at least two sets of rolls for engaging and intermittently interrupting the movement of the corrugated strips, and a cutting station for cutting predetermined lengths from said corrugated strips. Provision is made for adjusting the orientation of the rolls of one packing station relative to another to adjust the pitch or distance between corrugations. Provision is also made for selectively driving one set of the forming rolls for each strip without driving the other set of forming rolls. Provision is also made for selectively moving the cut off mechanism to one or the other of the sets of strips.

DESCRIPTION OF THE DRAWINGS

FIG. 3 is a fragmentary plan view on an enlarged scale taken along the line 3—3 in FIG. 1, parts being broken away.

FIG. 4 is a view taken along the arrow 4 in FIG. 3, parts being broken away.

FIG. 5 is a view taken along the arrow 5 in FIG. 3, parts being broken away.

FIG. 8 is a fragmentary sectional view taken along the line 8—8 in FIG. 9.

FIG. 9 is a part sectional elevational view of the web forming station.

FIG. 12 is a fragmentary sectional view taken along the line 12—12 in FIG. 11.

DESCRIPTION

Figure 1:
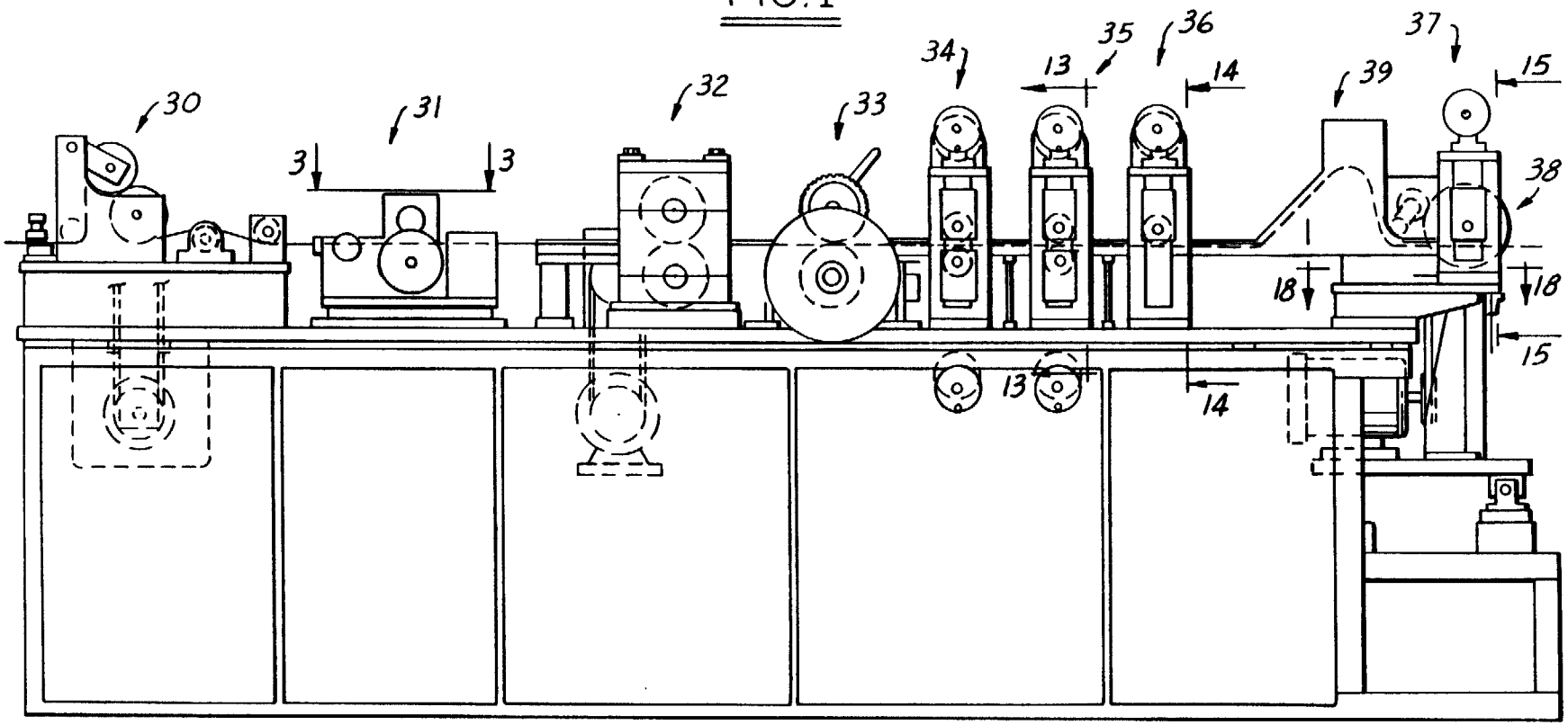
FIG. 1 is an elevational view of an apparatus embodying the invention.
Figure 2:
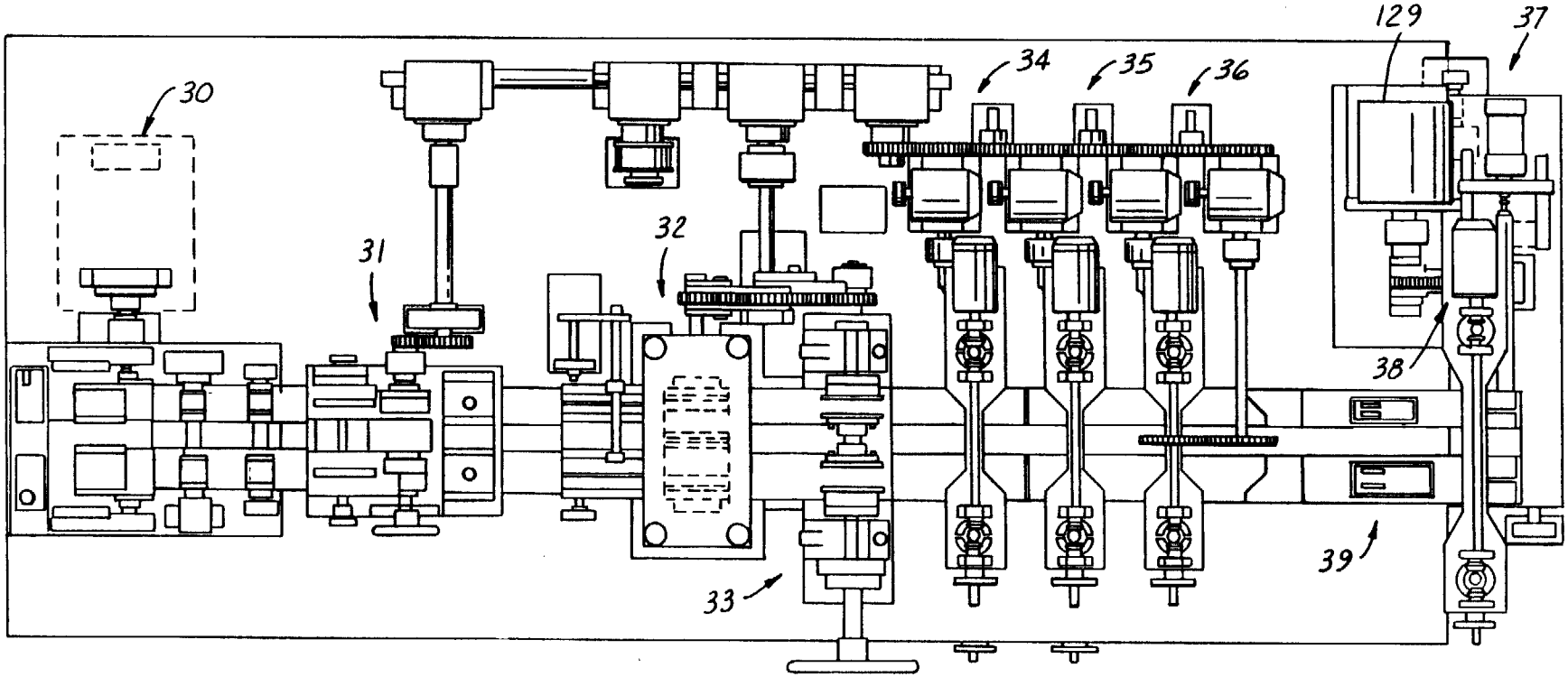
FIG. 2 is a plan view of the apparatus shown in FIG. 1, parts being broken away.
Figure 6:
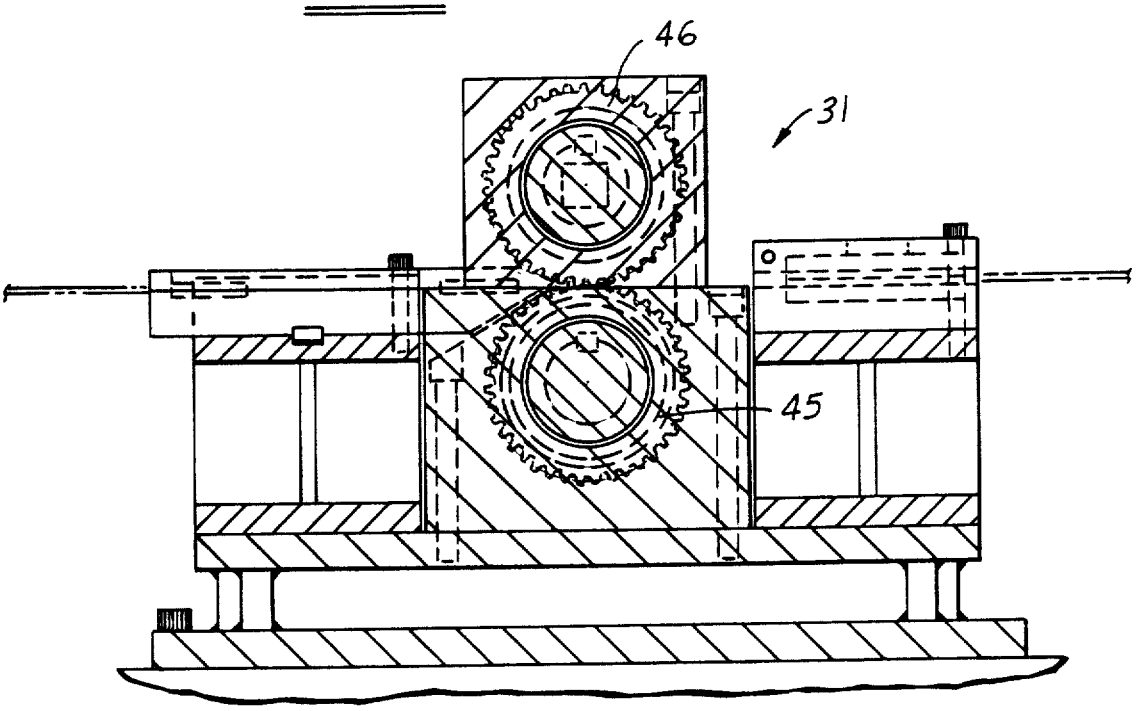
FIG. 6 is a fragmentary sectional view taken along the line 6—6 in FIG. 3.
Figure 7:
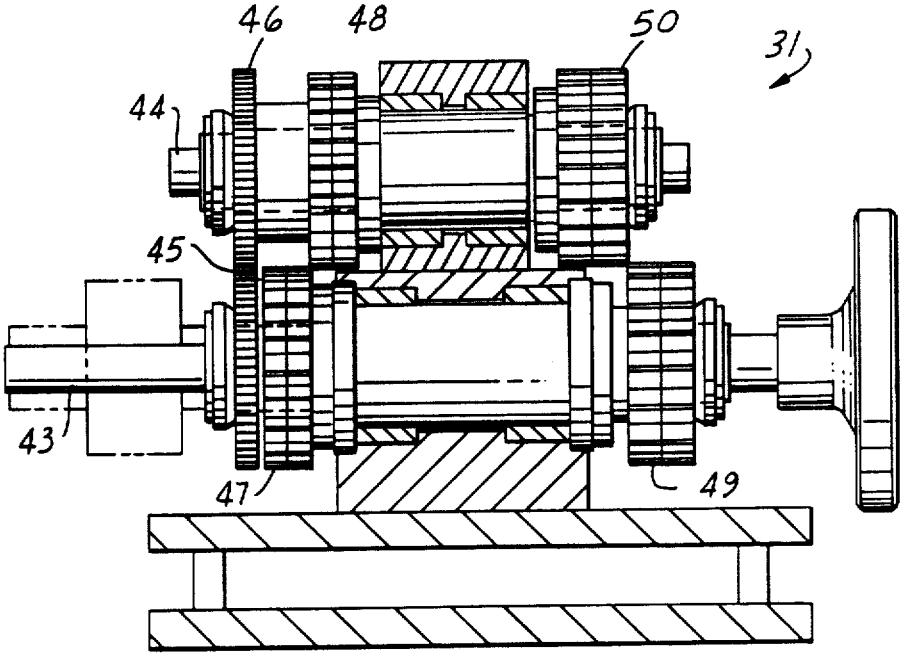
FIG. 7 is a fragmentary sectional view taken along the line 7—7 in FIG. 3.
Figure 10:
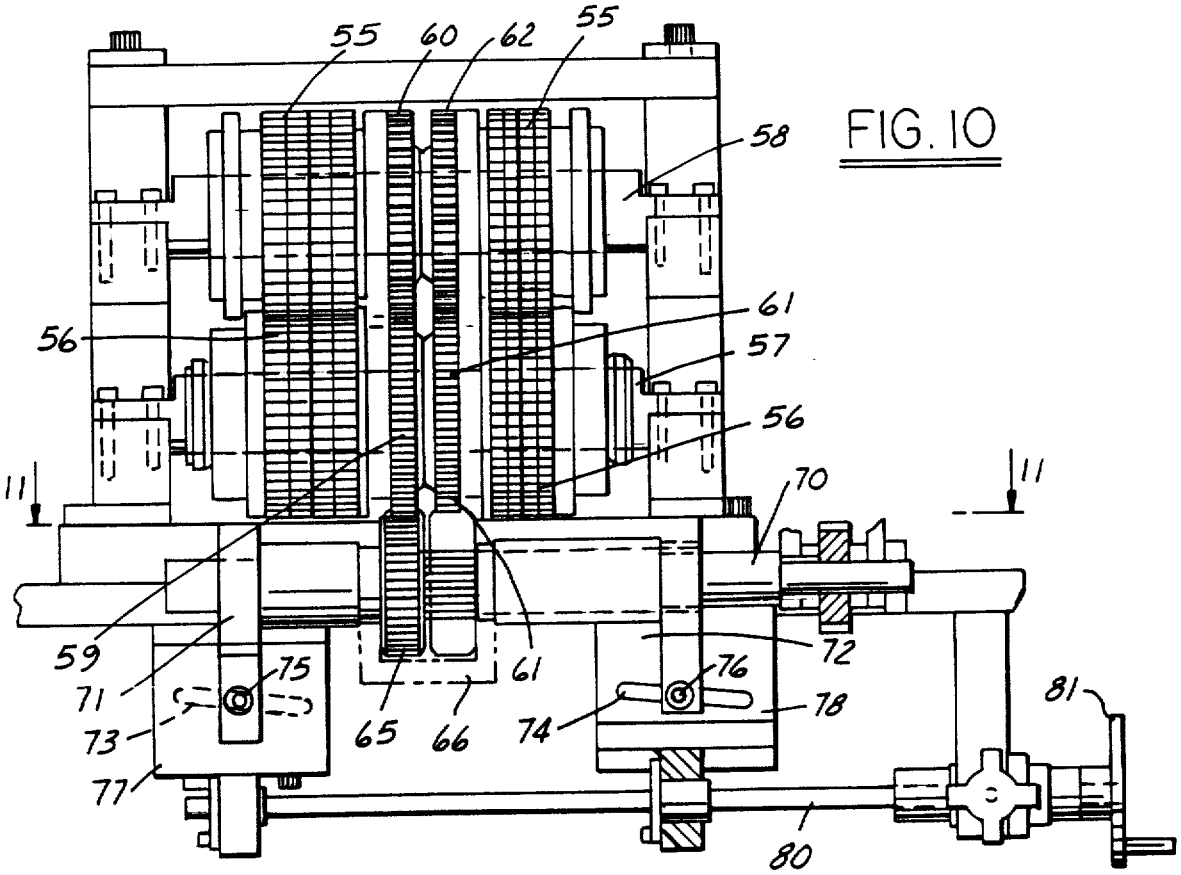
FIG. 10 is a part sectional view taken along the arrow in FIG. 8.

Referring to FIGS. 1 and 2, the apparatus embodying the invention is adapted to receive a web A or B from a coil. The selected web passes through a tension roll station 30 successively to a slitting roll station 31 where the web is slitted into plural strips. The strips thereafter pass to a web forming or generating roll station 32 and a starwheel roll station 33 which aids in exiting of the corrugated strip from the web forming or generating roll station 32. The formed strips are then fed successively through a first roll packing or density control station 34, a second roll packing or density control station 35 and a third roll packing or density control station 36 which functions to control the longitudinal spacing between corrugations on the strips. The strips are then fed to a web control roll station 37 which is run intermittently and operates to interrupt the formed strips at a cutting station 38 and thereafter permit web to move and accelerate until another length is provided at the cutting station. An accumulating or hump station 39 is provided between the third packing roll station 36 and the control or feed out roll station 37.

Referring to FIGS. 3–7, the slitting roll section is adapted to receive selectively a flat web A or a flat web B and slit the respective web into two strips for subsequent forming of corrugations. The station 31 includes guides or tracks 41, 42 which selectively receive the webs A, B, respectively, and guide them between slitter rolls. More specifically, the station 31 includes a lower shaft 43 and an upper shaft 44 interengaged by gears 45, 46 and supporting, respectively, a first set of slitter rolls 47, 48 and a second set of slitter rolls 49, 50. The guides 41, 42 are adapted to translated transversely by rotation of knobs 51, 52 which thread shafts 53, 54 into the slides 41, 42 respectively and translate them relative to the base 40.

Figure 11:
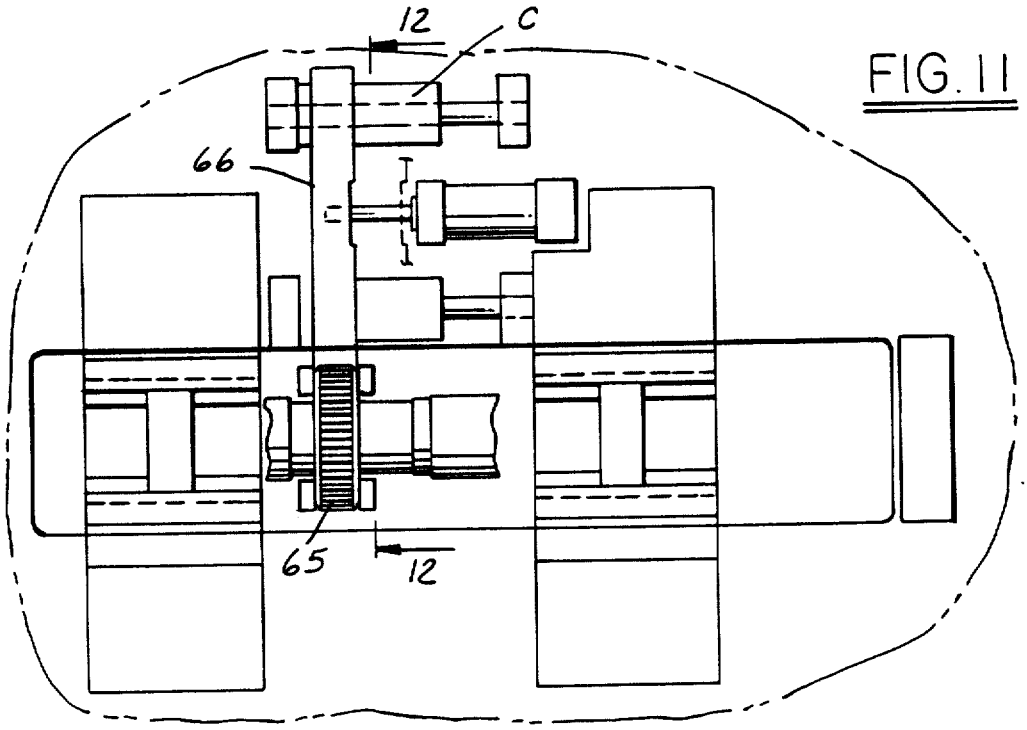
FIG. 11 is a fragmentary sectional view taken along the line 11—11 in FIG. 10.

Referring to FIGS. 8–12, the strip forming or generating roll station 32 comprises a plurality of sets of starwheels 55, 56 rotatably mounted on a lower shaft 57 and an upper shaft 58, respectively. Two sets of starwheels are provided on each shaft which may be selectively driven, as presently described, in order to form either the two narrow strips slit from the web A or the two wider strips slit from the web B as the strips move along a tack or tunnel T. Each starwheel 55, 56 is provided with gears 59, 60 or gears 61, 62 that mesh one another. Provision is made for selectively driving the gears 59, 60 of each of the sets by movement of a drive gear 65 into engagement with one or the other of the lower gears 59, 61. As shown in FIG. 11, the gear 65 is mounted within a cage 66 which is translatable longitudinally by a cylinder C relative to shaft 57 to move the gear 65 into engagement with one or the other of the gears 59, 61.

Provision is also made for moving the gear 65 vertically to accommodate changes in starwheels of different pitch diameter of rolls. In order to achieve this, the gear 65 is mounted on a shaft 70 that, in turn, is mounted on slides 71, 72, each of which has a pin 75, 76 that extends into slots 73, 74 on fixed brackets 77, 78. Rotation of a shaft 80 by a handwheel 81 functions to translate the brackets 71, 72 moving the brackets on which the shaft 70 is mounted vertically as desired.

Figure 13:
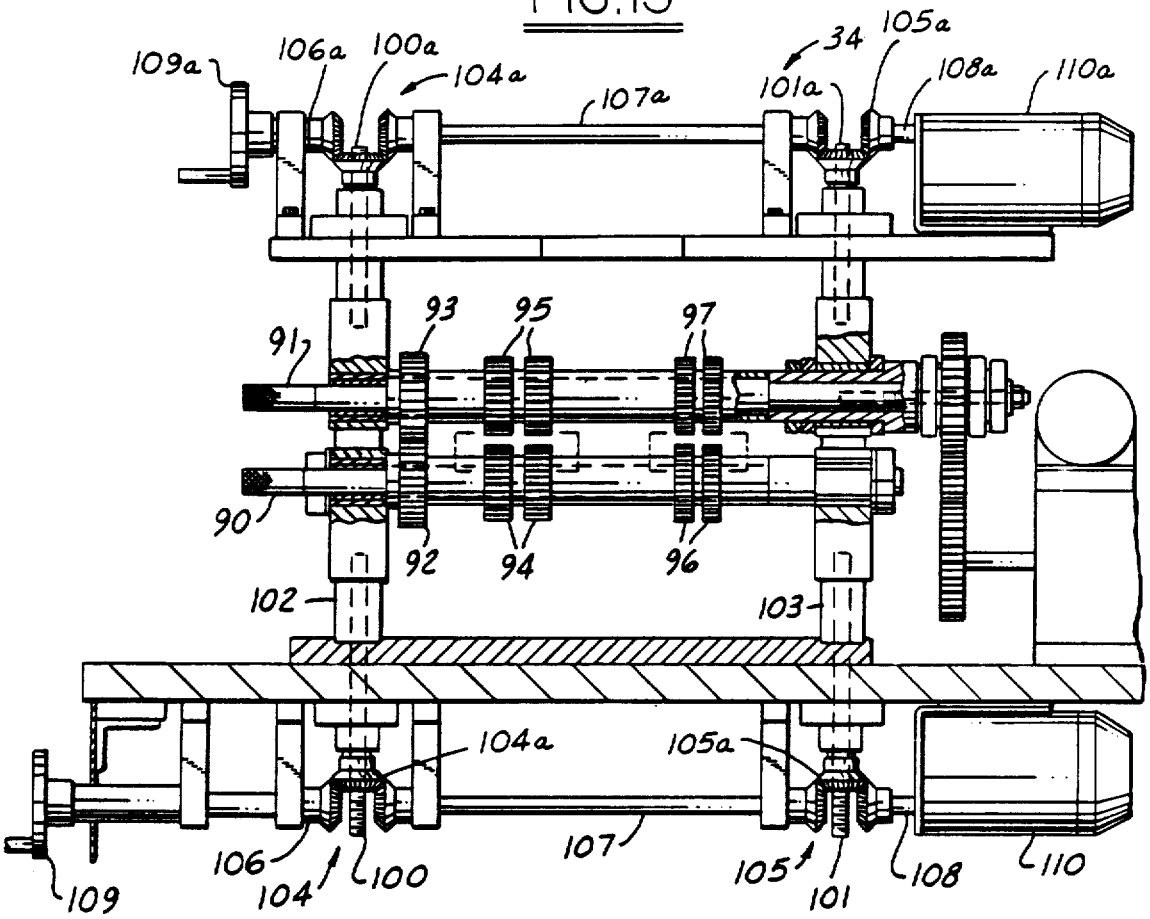
FIG. 13 is a fragmentary sectional view on an enlarged scale taken along the line 13—13 in FIG. 1.

Referring to FIG. 13, the first roll packing station 34 and the second roll packing station 35 are identical and comprise lower and upper shafts 90, 91 that are rotatably mounted on the frame F and are interengaged by gears 92, 93 for driving the pairs of starwheels 94, 95, or 96, 97 which control the spacing between corrugations. One set of starwheels is provided for the strips slit from web A and the other from the strip slit from web B. The gears 93 and rolls 94–97 are mounted on tubes that are telescoped over and splined to shafts 90, 91.

Provision is made for moving the respective supports for the shafts 90, 91 vertically as may be required for adjustment and comprises vertical screws threaded into the blocks that support the shafts adapted to be rotated by handcranks through bevel gears or motors. Specifically, the starwheels 94, 96 are mounted on shaft 90, which, in turn, is supported on blocks 102, 103 that are translatable vertically. Screws 100, 101 are connected to blocks 102, 103 so that translation of the screws 100, 101 translates the blocks 102, 103 vertically thereby moving the starwheels 94, 96 vertically. The screws 100, 101 are threaded into bevel gear **104*a*, 105*a* of bevel gear systems 104, 105 which are, in turn, rotated by shafts 106, 107, 108 by either a handwheel 109 or a motor 110. Similarly, the upper shaft 91 and starwheels 95, 96 are movable vertically by an arrangement that includes screws, bevel gears and shafts, identified in FIG. 13** with corresponding reference numerals and the suffix "a".

Figure 23:
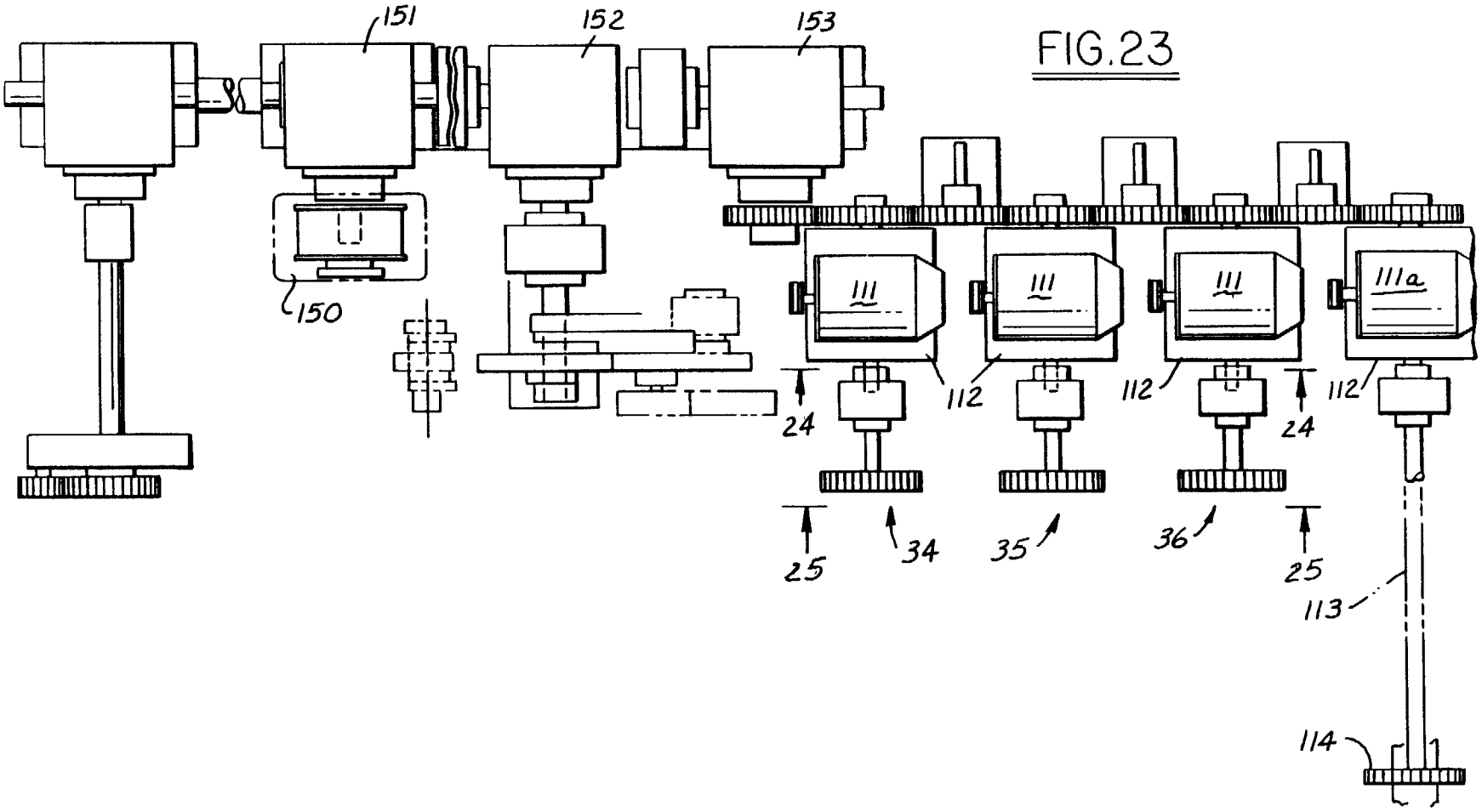
FIG. 23 is a part sectional plan view showing the drive system.

Referring to FIG. 23, each roll packing station 34, 35, 36 is provided with a motor 111 and a differential for momentarily driving the respective rolls to change the spacing or density of the corrugations in a unit length of corrugated strip.

Figure 14:
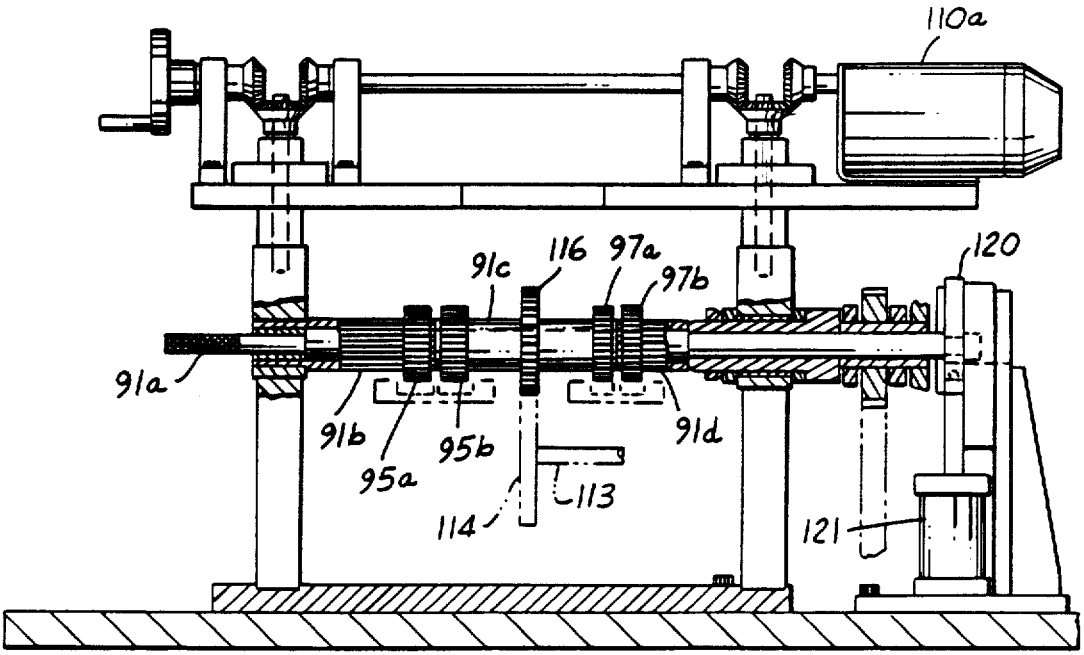
FIG. 14 is a fragmentary sectional view on an enlarged scale taken along the line 14—14 in FIG. 1.
Figure 15:
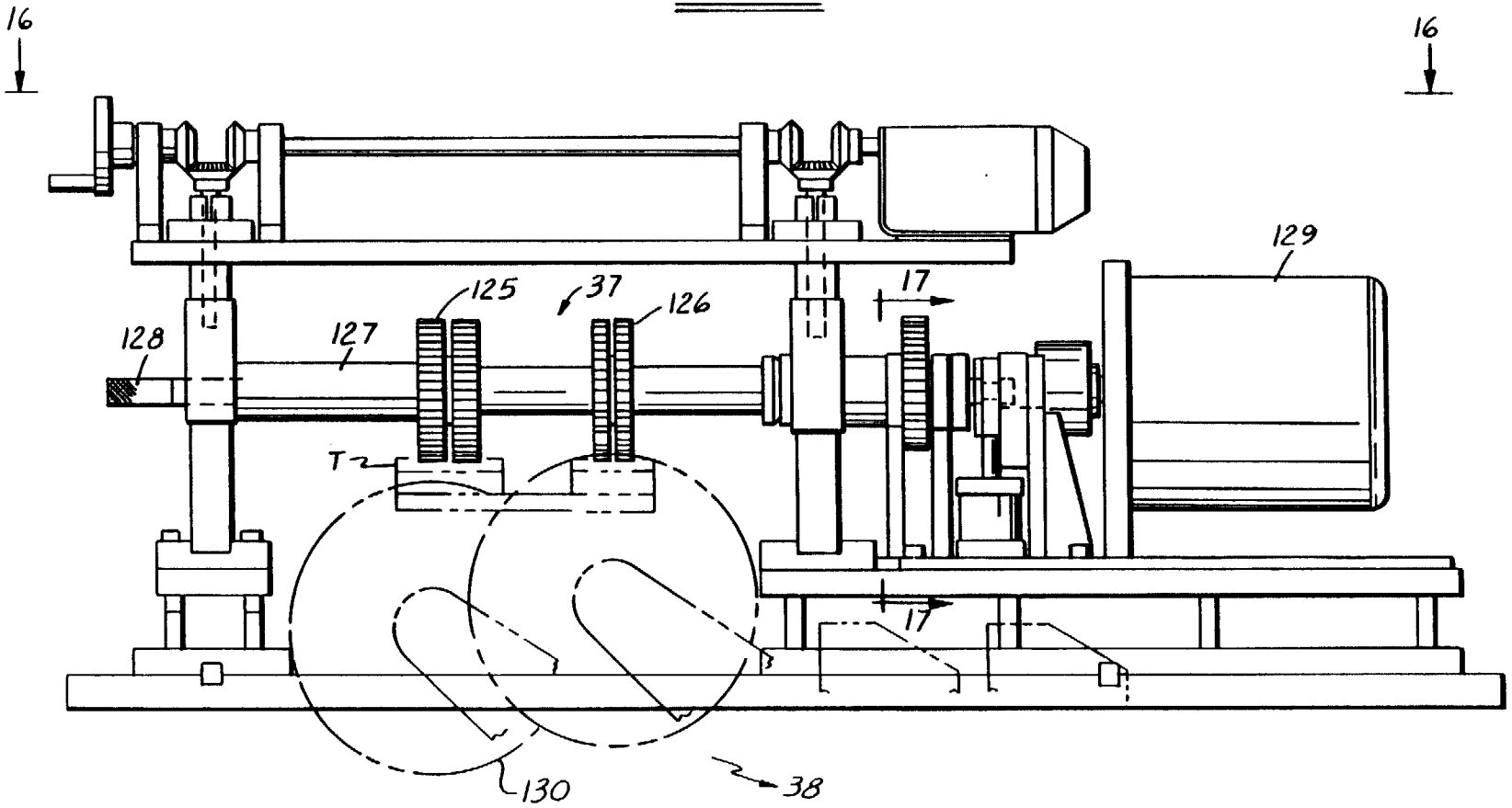
FIG. 15 is a fragmentary sectional view on an enlarged scale taken along the line 15—15 in FIG. 1.
Figure 16:
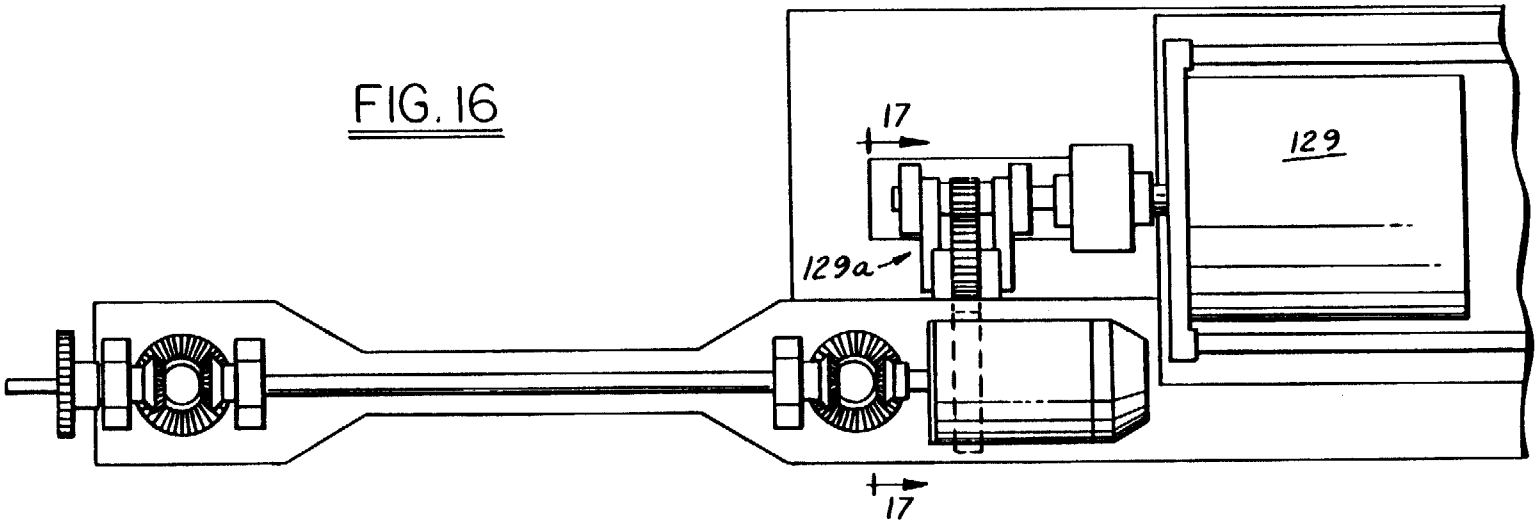
FIG. 16 is a fragmentary view taken along the line 16—16 in FIG. 15.
Figure 18:
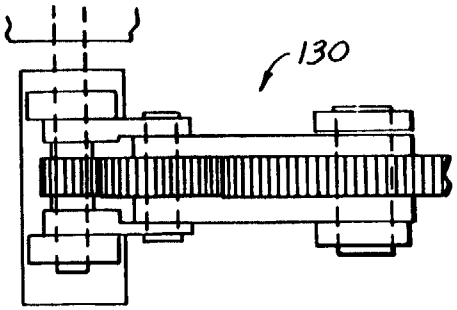
FIG. 18 is a fragmentary sectional view taken along the line 18—18 in FIG. 1.
Figure 17:
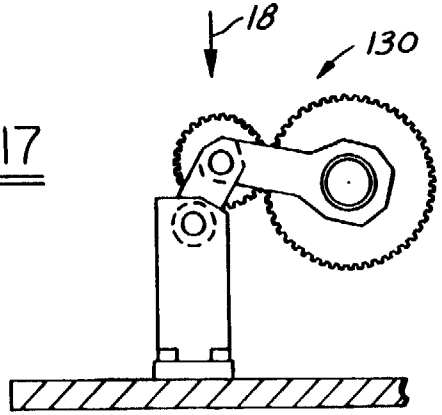
FIG. 17 is a fragmentary sectional view taken along the line 17—17 in FIG. 15.
Figure 19:
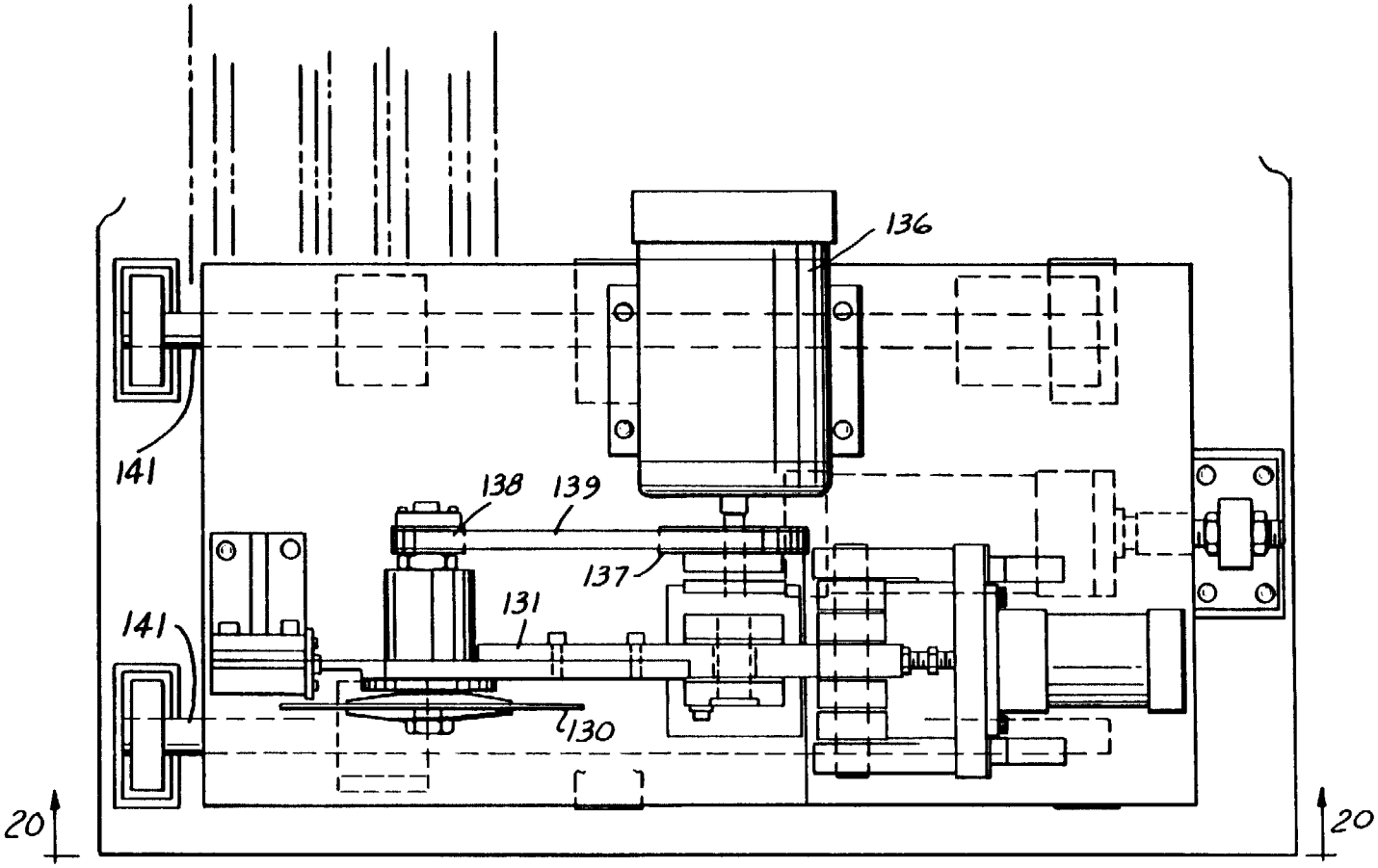
FIG. 19 is a fragmentary view taken along the line 19—19 in FIG. 1.

Referring to FIG. 14, the third roll packing station 36 differs from the first and second roll packing stations 34, 35 in that it includes only an upper set of rolls **95*a*, 97*a* which engage the corrugated strips as they are moved along tunnels. If the first height is large, the third roll packing station can comprise an upper and a lower set of rolls. Provision is made for individually adjusting the rotational position of one gear 95*a* relative to the other gear 95*b* or 97*a* relative to 97*b* in order to precisely engage the corrugations of the strips and adjust the pitch of the corrugations in one strip relative to an adjacent strip. In this arrangement, each of the gears 94*a*, 94*b* or 96*a*, 96*b* of each set is rotatable relative to the other. Specifically, this is achieved by moving roll 95*a* on a tube 91*b* splined to shaft 91*a*, rolls 95*b* and 97*a* on a tube 91*c* rotatably mounted on shaft 91*a* and roll 97*b* on a tube 91*d* splined to shaft 91*a*. A gear motor 111*a* is connected to a differential 112*a* to provide a momentary rotation of a shaft 113, gears 114, 115 to a center gear 116 on tube 91*c*. This momentarily rotates rolls 95*b*, 97*a* relative to their respective rolls 95*a*, 97*b*. As a result the pitch of the corrugations in the strip which is engaged by rolls 95*b* or 97*a* is changed relative to the pitch of the strip engaged by roll 95*a* or 97*b***.

Provision is made for vertical adjustment as in the previous form. Provision is made for ready disengagement and removal of the shafts at the roll stations 34, 35 36. Each shaft is maintained in position by a yoke retainer 120 which can be retracted by an operation of a cylinder 121 permitting the respective shaft to be removed axially by hand.

Figure 20:
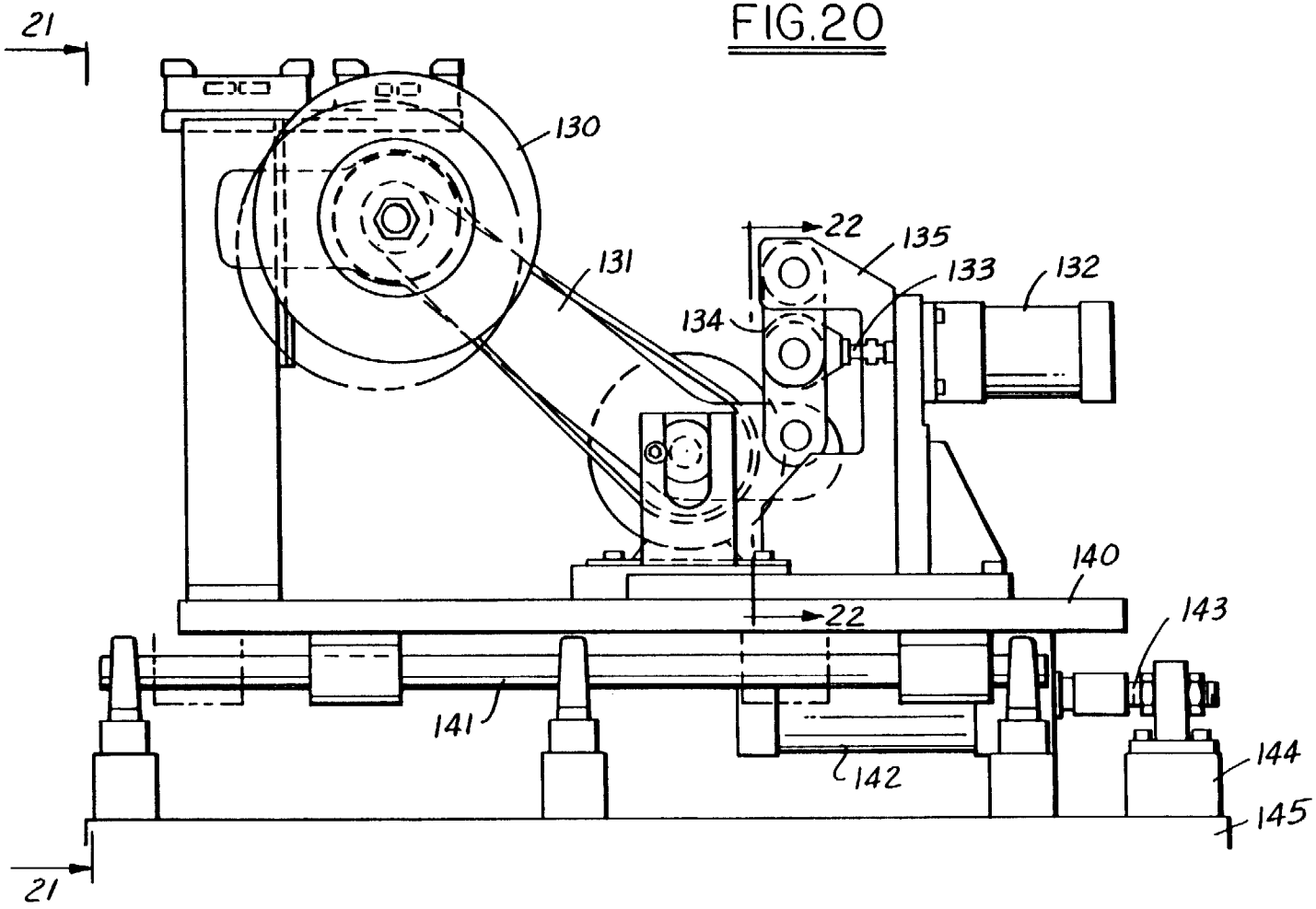
FIG. 20 is a fragmentary view taken along the line 20—20 in FIG. 19.
Figure 21:
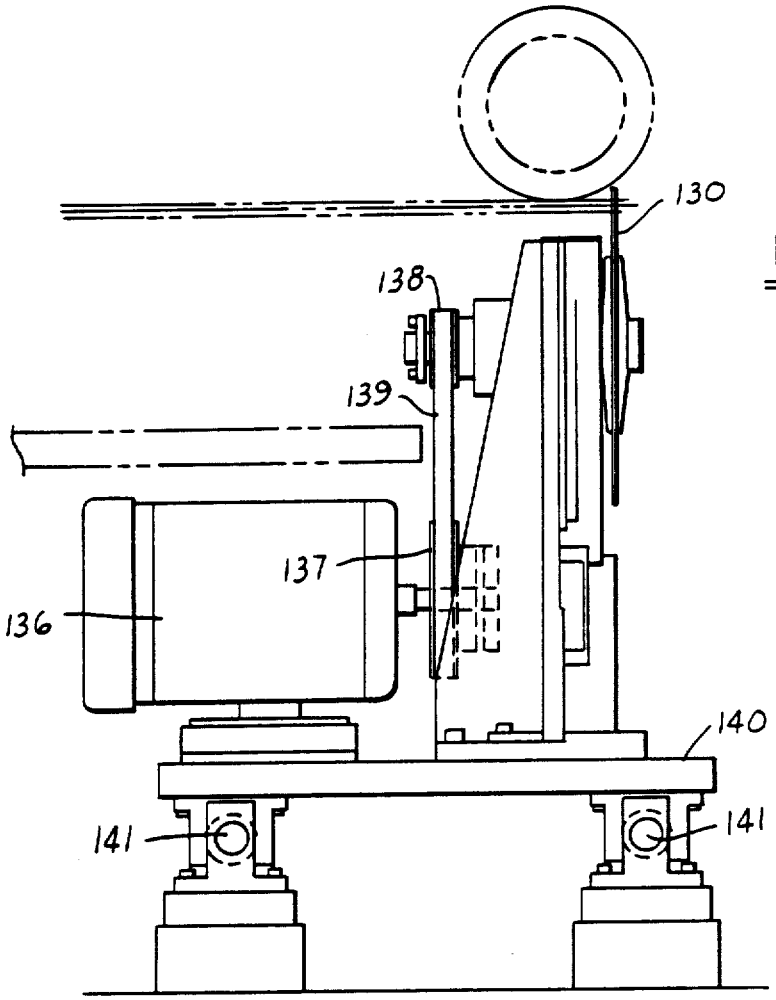
FIG. 21 is a fragmentary sectional view taken along the line 21—21 in FIG. 20.
Figure 22:
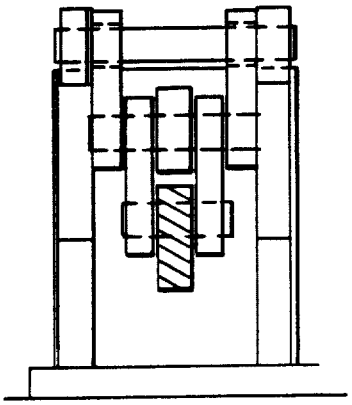
FIG. 22 is a fragmentary sectional view taken along the line 22—22 in FIG. 20.

Referring to FIGS. 15–22, the web control roll station 37 adjacent the cutter station 38 includes two sets of corrugated rolls 125, 126 mounted on a tube 127 which is splined to shaft 128 and driven intermittently by servomotor 129 through gear **129*a*. The rolls 125, 126 are adapted to hold the pairs of strips in tunnels or tracks T. Provision is made for raising and lowering the rolls as may be desired, in a manner as described above in connection with the density rolls. The cutting station 38 includes a rotary cutting blade 130 mounted for swinging movement on an arm 131 which is raised and lowered as shown in FIG. 20 by a cylinder 132 that has its shaft 133 pivoted to a link 134. The link 134 is pivoted at one end to a bracket 135 and at its other end to the lever 131 so that by actuation the cylinder 132 the rotary cutting blade is moved vertically to severe a length of corrugated strip. The rotary blade 130 is rotated by a motor 136 through pulleys 137, 138 and a belt 139**.

The bracket 135 is mounted on a table 140 which is slidably mounted on parallel shafts 141 so that the table and in turn the rotary blade can be shifted into position for severing the strips associated with rolls 125 or 126 as the case may be. The movement of the table and in turn the rotary blade 130 is achieved by a cylinder 142 mounted on the table 140 and having a piston rod 143 which is fixed by bracket 144 on the floor or other base 145. Thus the rotary blade can be translated transversely to a position for cutting strips which have their movement interrupted by the rolls 125 or 126. When the movement of a corrugated strip is interrupted by operation of the servomotor 129, the blade 130 can be actuated by cylinder 132 vertically to engage the strip through a slot in the tunnels or tracks and severe a predetermined length of corrugated strip from each of the two strips.

Referring to FIG. 23, the apparatus includes a single drive for the apparatus except for the control rolls 125, 126 and generally comprises a motor 150 which drives a gear box 151 and successive gear boxes 152, 153. The gear box 153 is connected by gearing to the drive for each of the roll stations 34, 35, 36. As described above, normally the drive to the rolls of the stations 34, 35 and 36 are synchronized. During operation, if necessary, the relative rotational position of one set of rolls in any of the stations 34, 35, 36 can be adjusted relative to another station by a momentary operation of the motor 111 and associated differential transmission 112. In addition, as heretofore described a momentary rotation may be provided to the rolls of the third station to change the pitch of the corrugations between adjacent strips that are moving along the tunnel or track of the apparatus.

It can thus be seen that there has been provided an apparatus which will produce metal strips having high productivity; wherein the apparatus can be quickly changed to produce multiple strips simultaneously; wherein the apparatus can be quickly changed to produce strips of different widths; which can utilize a web from a coil of greater width that is slitted to form plural strips simultaneously; which has packing roll stations, each of which is independently adjustable during operation; which has improved control of concentricity of the rolls; wherein the packing roll stations may be independently adjusted with respect to prior stations for changing the pitch or distance between corrugations during operation; wherein the rolls can be easily removed and replaced thereby minimizing downtime; and wherein a further station is intermittently driven to control the number of fin convolutions per inch, and which has a cut-off station which is movable selectively transversely of the apparatus to sever a length of fins.

I claim:

1. A corrugated web forming apparatus for receiving selectively one of a plurality of webs of flat material and slitting one of said webs to form two strips which are thereafter shaped to form corrugations and severed to form shaped portions having predetermined lengths, predetermined heights and predetermined spacing between the corrugations which comprises a slitting station including at least two sets of slitting rolls adapted to be used selectively for slitting a respective web, a forming station including laterally spaced sets of forming rolls, each set including forming rolls for transversely corrugating two strips severed from a web simultaneously, said forming station including means for selectively driving only one of said sets of forming rolls, a plurality of longitudinally or laterally spaced sets of roll packing stations for controlling the longitudinal spacing between the corrugations on two strips, each roll pack station comprising a set of packing rolls, means for driving said packing rolls in synchronization, a web accumulating station including rolls for engaging and intermittently interrupting the movement of the two corrugated strips, and a cutting station for cutting predetermined lengths from said two corrugated strips.

2. The corrugated fin forming apparatus set forth in claim 1 wherein at least one of said roll packing stations includes means for adjusting said packing rolls toward and away from one another during operation of the apparatus.

3. The corrugated fin forming apparatus set forth in claim 2 wherein each set of packing rolls is adjustable during operation independent of the other.

4. The corrugated fin forming apparatus set forth in claim 1 wherein said last-mentioned packing rolls of each set are rotationally adjustable relative to one another.

5. The corrugated fin forming apparatus set forth in claim 1 wherein said cutting station includes a cutting mechanism that is selectively operated to sever portions from one or the other pair of strips which are selectively formed by the slitting station.

6. The apparatus set forth in claim 1 wherein said means for driving said packing rolls includes means for momentarily rotating the rolls of a station relative to another to change the pitch of a strip.

7. A corrugated web forming apparatus for receiving a web of flat material to form a strip which is thereafter shaped to form corrugations and severed to form shaped portions having predetermined lengths, predetermined height and predetermined spacing between the corrugations which comprises a forming station including forming rolls for transversely corrugating a strip severed from a web, a plurality of longitudinally spaced roll pack stations for controlling the longitudinal spacing between the corrugations on a strip, each roll pack station comprising a set of packing rolls, means for driving said packing rolls in synchronization, a web accumulating station including rolls for engaging and intermittently interrupting the movement of the corrugated strip, a cutting station for cutting a predetermined length from said corrugated strip, and said means for driving said packing rolls including means for momentarily rotating the rolls of one station relative to another to change the pitch of a strip.

8. The corrugated fin forming apparatus set forth in claim 7 wherein each said roll packing station includes means for adjusting said packing rolls toward and away from one another during operation of the apparatus.

9. The corrugated fin forming apparatus set forth in claim 7 wherein each set of packing rolls is adjustable during operation.

10. The corrugated fin forming apparatus set forth in claim 7 wherein said last-mentioned packing rolls are provided in sets which are rotationally adjustable relative to one another.

11. A corrugated web forming apparatus for receiving a web and slitting said web to form two strips which are thereafter shaped to form corrugations and severed to form shaped portions having predetermined lengths, predetermined heights and predetermined spacing between the corrugations which comprises a slitting station for slitting a web, a forming station including laterally spaced sets of forming rolls for transversely corrugating two strips severed from a web simultaneously, a plurality of longitudinally spaced roll pack station for controlling the longitudinal spacing between the corrugations on the strips, each roll pack station comprising a set of packing rolls, means for driving said packing rolls in synchronization, a web accumulating station including rolls for engaging and intermittently interrupting the movement of the corrugated strips, a cutting station for cutting predetermined lengths from said corrugated strips, and said means for driving said packing rolls including means for momentarily rotating the rolls of one station relative to another to change the pitch of a strip.

12. The corrugated fin forming apparatus set forth in claim 11 wherein each said roll packing station includes means for adjusting said packing rolls toward and away from one another during operation of the apparatus.

13. The corrugated fin forming apparatus set forth in claim 12 wherein each set of packing rolls is adjustable during operation independently of the other.

14. The corrugated fin forming apparatus set forth in claim 11 wherein said slitting station includes a cutting mechanism that is selectively operated to sever portions from one or the other of strips which are selectively formed by the slitting station.

15. A corrugated web forming apparatus for receiving a web of flat material to form a strip which is thereafter shaped to form corrugations and severed to form shaped portions having predetermined lengths, predetermined height and predetermined spacing between the corrugations which comprises a forming station including forming rolls for transversely corrugating a strip severed from a web, a plurality of longitudinally spaced roll pack stations for controlling the longitudinal spacing between the corrugations on a strip, each roll pack station comprising a set of packing rolls, means for driving said packing rolls in synchronism, a web control station including rolls for engaging and intermittently interrupting the movement of a corrugated strip, a cutting station for cutting a predetermined length from said corrugated strip, and said means for driving said packing rolls including means for momentarily rotating the rolls of one station relative to another to change the pitch of a strip.

* * * * *